US005263766A

United States Patent [19]

McCullough

[11] Patent Number: 5,263,766

[45] Date of Patent: Nov. 23, 1993

[54] CHILD'S FURNITURE AND METHOD OF MAKING

[76] Inventor: Rodger A. McCullough, 1 N. Main St., Covington, Ohio 45318

[21] Appl. No.: 853,585

[22] Filed: Mar. 18, 1992

[51] Int. Cl.[5] ..... A47C 7/00

[52] U.S. Cl. ..... 297/440.13; 297/440.16; 403/346

[58] Field of Search ..... 297/442, 443, 444, 440; 403/345, 354, 364, DIG. 10, 346, 347, 375; 248/165; 5/114, 285, 288

[56] References Cited

U.S. PATENT DOCUMENTS

| | | | |
|---|---|---|---|
| D. 251,641 | 4/1979 | Chacon | D6/63 |
| 607,607 | 7/1898 | Rimmelin | 403/364 X |
| 1,508,697 | 9/1924 | Junker . | |
| 1,763,748 | 6/1930 | Best | 248/165 X |
| 2,097,172 | 10/1937 | Yurkovitch | 403/347 X |
| 2,506,346 | 5/1950 | Crawford | 108/51.3 |
| 2,551,071 | 5/1951 | Tyng | 248/165 X |
| 3,351,028 | 11/1967 | Davidson | 108/51.3 |
| 3,396,933 | 8/1968 | Ward | 297/442 X |
| 3,527,497 | 9/1970 | Self | 297/442 |
| 3,547,491 | 12/1970 | Bovasso | 297/440 X |
| 3,788,700 | 1/1974 | Wartes | 297/442 |
| 4,140,065 | 2/1979 | Chacon | 297/440 X |
| 4,593,950 | 6/1986 | Infanti | 297/442 X |

OTHER PUBLICATIONS

Palmer, Bruce Making Children's Furniture and Play Structures, 1974, pp. 24–25.

*Primary Examiner*—Kenneth J. Dorner
*Assistant Examiner*—Milton Nelson, Jr.
*Attorney, Agent, or Firm*—William Weigl

[57] ABSTRACT

A unit of child's furniture such as a chair or sofa is constructed of intersecting panels provided with a unique interlocking joint which provides strength, rigidity and long life to such furniture. In one form, each panel is made of a pair of triple wall corrugated cardboard sheets which are individually slotted and channeled to provide different portions of its joint, and which thereafter have their sides cemented together to form a double thickness corrugated panel. The furniture is preferably made so it can be transported and stored in flat, knockdown condition and assembled when needed.

5 Claims, 2 Drawing Sheets

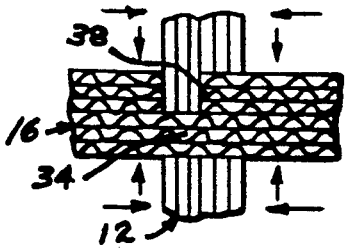
FIG. 4
FIG. 1
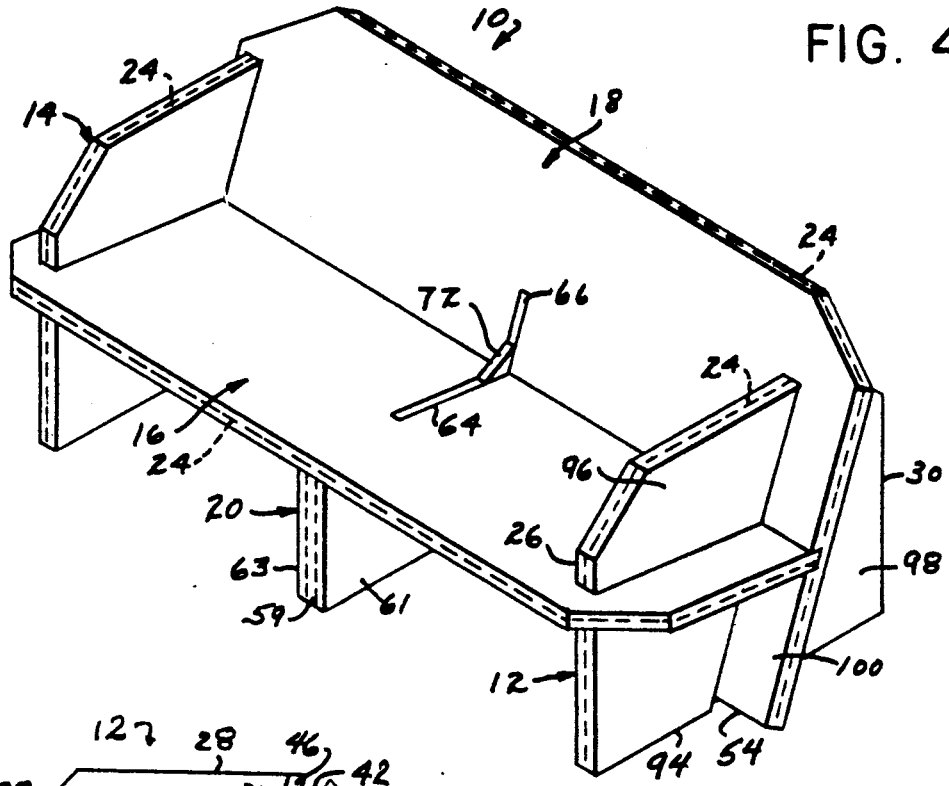
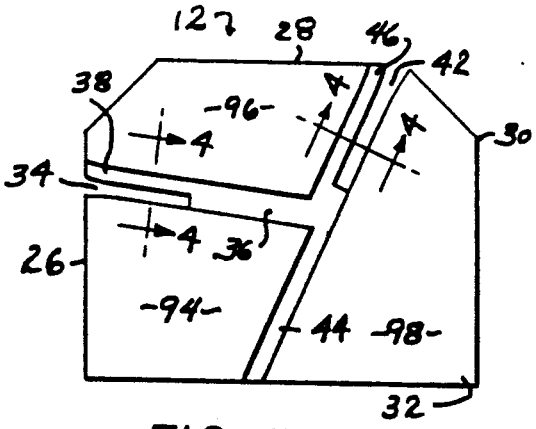
FIG. 3
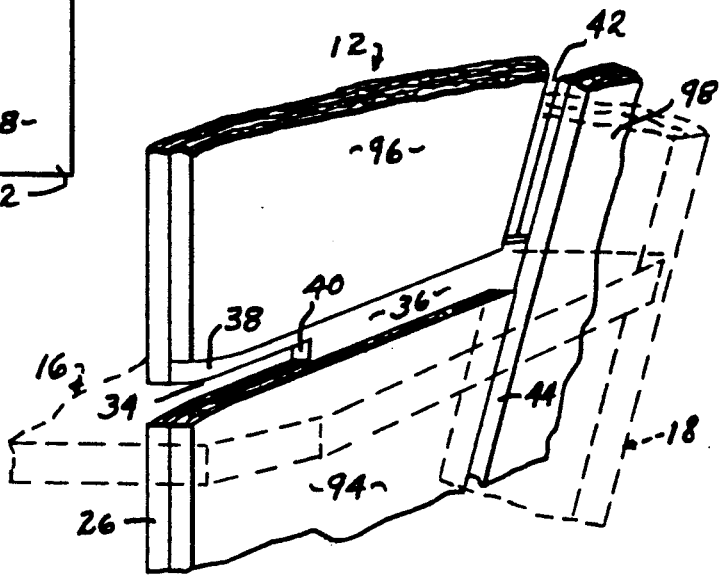
FIG. 2

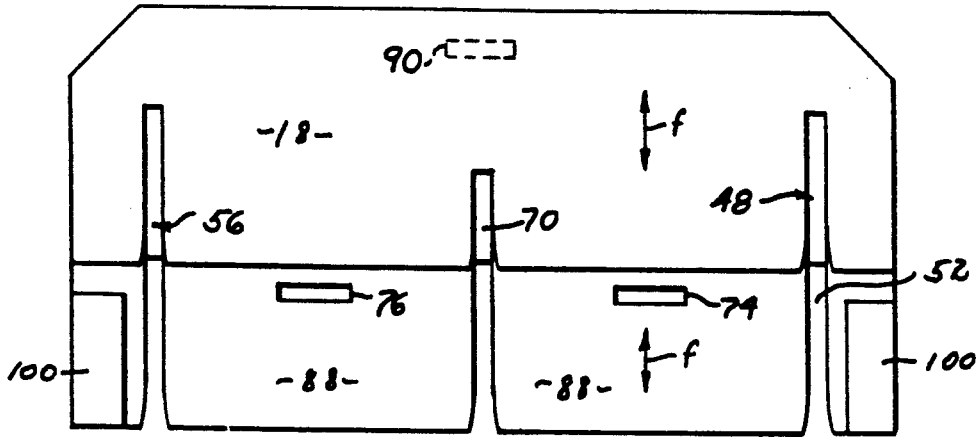
FIG. 5
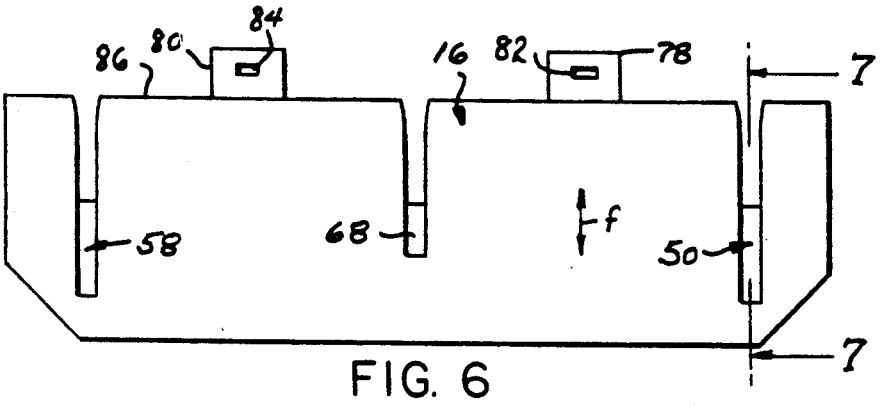
FIG. 6
FIG. 8
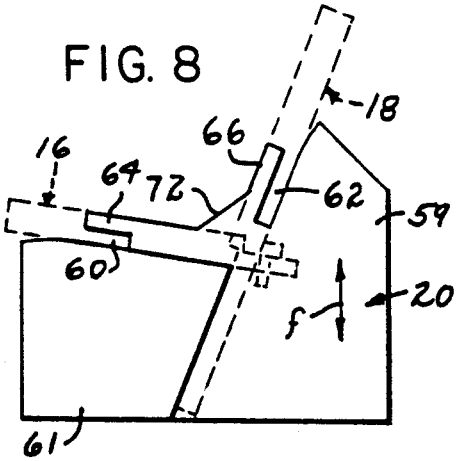
FIG. 9
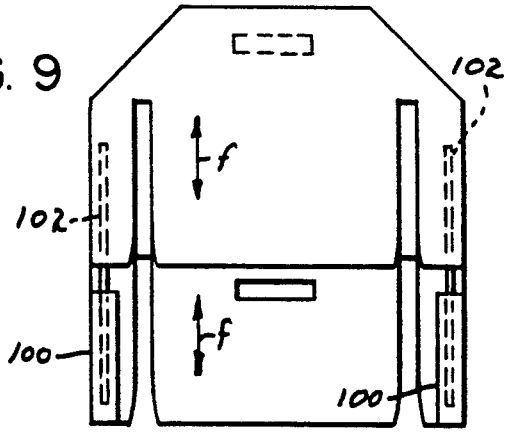
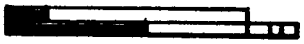
FIG. 7
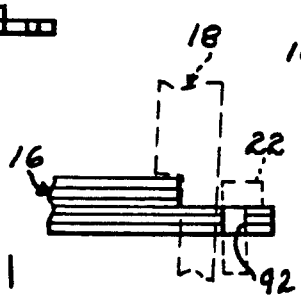
FIG. 11
FIG. 10
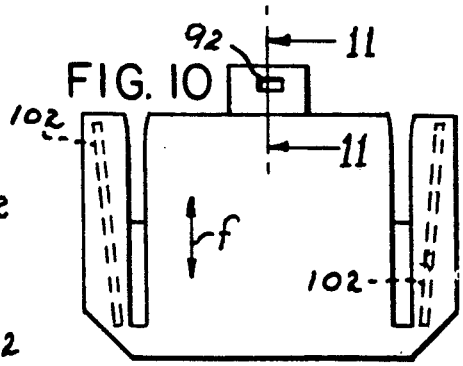

CHILD'S FURNITURE AND METHOD OF MAKING

This invention relates generally to children's furniture and to a method of making corrugated cardboard panels for such furniture.

BACKGROUND OF THE INVENTION

Corrugated cardboard has long been a favorite construction material of children, because of its ready availability in the form of shipping and other containers. Its ease of cutting, though often requiring adult assistance, enables use as playhouses and storage boxes for toys and other children's things. Most such containers are of a single wall thickness, i.e., a lamination of two flat sheets of kraft paper with fluted kraft paper which is cemented between the flat sheets. Some containers are of double wall thickness, being similarly constructed, but having three flat sheets with two fluted sheets between adjacent pairs of the flat sheets. Because of the added strength of the double wall board, other children's products could be made, products which were able to provide some measure of support of somewhat heavier items. However, neither single nor double wall cardboard is desirable for supporting a child's weight at least not for very long, and particularly under ordinary conditions of activity of the child.

There also exists corrugated cardboard referred to as triple wall, consisting of four flat sheets and three fluted sheets, one of each of which is sandwiched between each adjacent pair of flat sheets. This product is readily available from Tri-Wall Containers, Inc. of Butler, Ind. One use of such triple wall board is in single thickness panels (but hereinafter often referred to as sheets) for various pieces of children's furniture, e.g., stools, storage units, chairs, loungers, bookcases, desks and numerous other items. Triple wall corrugated board is immensely strong for its weight, and is about one-third the weight of plywood. Test weight for a triple wall corrugated sheet is rated at 1100 pounds.

Although triple wall corrugated board is useful to support a small child up to about five or six years of age when made into a chair, for example, the typical slotted, intersecting plane construction of the panels making up the chair makes a useful life of such a product rather limited. Depending on how the child sits, squirms or bounces in the chair and how often it is used, the expected life of even a triple wall corrugated cardboard chair is typically measurable in weeks. This is mainly due to the side thrust of the child's body against the sides of the chair, and the inability of the interrupted, relatively short joints of corrugated board to sustain such side thrust. Ordinarily, the juncture of the side panels with the seat and back panels of such a chair is the weakest point of a side panel, and this weakest point is also subjected to the greatest stress. The sides can also be subject to damage if the flutes of the sheets are vertical, since corrugated board has the greatest tendency to bend in the direction of the flutes of the board rather than across the flutes. Side thrust along the front vertical edge of the side of the chair can present a problem, since a common construction is to have the side panel slotted horizontally adjacent the front edge to receive the seat panel, leaving nothing but the strength of the panel itself to resist the lateral force from a child's thigh, for example. In most child's seat designs, the chair's weakest points are at the side panels, oftentimes at the very areas of greatest and most frequent pressures and forces from an active child.

SUMMARY OF THE INVENTION

A unit of child's furniture such as a chair or sofa is constructed of intersecting panels which are provided with unique interlocking joints. The joints add strength, durability and rigidity to the item, inherently increasing its useful life. The disclosed method of producing such panels from multiple wall corrugated cardboard to form the interlocking joints enables use of construction techniques which are best suited to corrugated board handling while protecting the board from damage during construction, such as might occur if known woodworking techniques were attempted to be employed with corrugated board. The joints so created are strong and durable, withstanding the wear and tear abuse to which children normally subject such furniture items.

A primary object of my invention is to provide lightweight furniture which is durable and able to withstand abuse during ordinary and normal use.

A further object is to provide a method of making corrugated cardboard furniture panels by slotting separate sheets of multiple thickness board and thereafter cementing them together.

An important object of all of the foregoing is to provide a unique interlocking joint for strengthening corrugated board furniture, such joint being produced as aligned through-slots and bottomed slots or channels formed in intersecting panels of the furniture.

A more specific object of my invention is to provide a durable corrugated cardboard child's chair, sofa, table, desk or any other unit of children's furniture which is normally subjected to rigorous physical action.

Another object is to provide such furniture in knockdown form to enable ease of transportation and storage.

A further object of my invention is to provide a child's chair which is so constructed that its panels may be completely interlocked with only a single key keeping all of the panels together.

Other object and advantages will become apparent from the following description in which reference is made to the accompanying drawings.

BRIEF DESCRIPTION OF THE DRAWINGS

FIG. 1 is a perspective view of an assembled child's sofa made in accordance with my invention.

FIG. 2 is a fragmentary enlarged perspective view of one form of my novel interlocking joint used to strengthen the furniture when assembled.

FIG. 3 is an upright view of a side panel of the sofa of FIG. 1, which side panel may also be used in a chair to be illustrated in FIGS. 9 and 10.

FIG. 4 is an enlarged fragmentary view taken substantially along lines 4—4 of FIG. 3, showing a pair of intersecting panels.

FIG. 5 is an upright view of a back panel of the sofa of FIG. 1.

FIG. 6 is a plan view of the seat panel of the sofa of FIG. 1.

FIG. 7 is a cross-sectional view of the seat panel of FIG. 6, and is taken along lines 7—7 of FIG. 6.

FIG. 8 is an upright view of a central supporting panel of the sofa of FIG. 1.

FIGS. 9 and 10 are back and seat panels respectively of a child's chair made according to the invention, said chair utilizing the side panel of FIG. 3 and a second side panel which is a mirror image of the FIG. 3 panel.

FIG. 11 is a detailed view of one type of means for simply locking all of the panels of the chair or sofa together as a complete unit, and is taken substantially along lines 11—11 of FIG. 10.

DESCRIPTION OF THE PREFERRED EMBODIMENTS

A child's sofa 10 capable of seating two or three children up to approximately age six is shown in FIG. 1. It consists of seven parts: a left side panel 12, a right side panel 14, a seat panel 16, a back panel 18, a central supporting panel 20 and a pair of keys 22 to be discussed in connection with FIG. 11. The sofa differs from a chair to be disclosed later in that the horizontal lengths of the seat and back differ and in the fact that a central support such as 20 is unnecessary for a chair because of its reduced side to side distance. In addition, only one key 22 is required for a chair. Therefore the chair consists of only five parts.

It will be noted that the plane of each panel intersects the planes of all of the other panels with which it is joined. For example, side panel 12 intersects both seat panel 16 and back panel 18. It will also be noted that all panels are illustrated with dotted lines 24 to indicate that in a preferred form of my invention, the panels are produced from a pair of sheets of corrugated board which have their sides cemented together and their edges sealed with kraft paper tape (not shown) to cover the flutes of the board and give the edges a finished appearance. The tape may be sufficiently wide to cover the combined thickness of the two separate corrugated sheets or it may cover only the edge of each sheet. Naturally, if each sheet is separately taped, a parting line will exist where the dotted lines 24 appear in FIG. 1.

While corrugated is the preferred method of construction material, it is to be understood that the unique interlocking joint to be described later is applicable to other construction materials as well. Use of such other materials with my joints would add strength and durability even if the material is not one requiring the extra strength. The joints may also allow use of thinner plywood panels than would otherwise be possible to achieve the same rigidity.

A basic problem exists in utilizing corrugated cardboard as the construction material. Foremost is the difficulty of using normal woodworking techniques and tools for constructing slots, channels and the like. Motorized tools have the tendency to scuff and create ragged edges where the tools contact the corrugated board, rather than leave the nice clean cut lines desired in furniture of any type. Since corrugated board cannot be finish sanded in the same manner as wood, any cut made should leave the cut line in a clean, finished condition. The only practical way of doing this that I have found is to make the cuts with a straight knife edge. Even a fine toothed blade of a saber saw presents difficulties, although it may be feasible to make the teeth so fine as to essentially constitute a knife blade in function.

Another difficulty encountered with corrugated is in the making of a channel. Dadoing such as is common in woodworking can control the depth of a channel, but because of the slight irregularity in thickness of most corrugated board, dadoing would leave a scruffy, ragged surface bottom in many instances. Dadoing tools are often detrimental to the surfaces of kraft paper. Especially if the dado were to be made crosswise of the fluting of the cardboard, ragged edges of the sides of the channel would most likely result.

Although corrugated can be die cut on a machine when the board is of single wall and sometimes double wall thickness, use of die cutting techniques for triple wall board of ½ to 9/16 inches thickness can crush the area surrounding the cut, weakening the area as well as making it unsightly in a piece of furniture. While not wishing to be limited to cutting with a knife except where specifically claimed, I have as yet found no other way of satisfactorily cutting the board to achieve the desired results except with a knife edge.

Proceeding now to the details of construction of the sofa 10, left side panel 12 is shown in FIG. 3 as having a front edge 26, a top edge 28, a back or rear edge 30 and a bottom edge 32. A slightly downwardly inclined but essentially horizontal through-slot 34 extends partially from the front edge 26 toward the back edge 30 approximately one-half the front to back depth of the seat panel 16. The drawings depict slot 34 (and all other such slots) to be slightly flared at its outer end for subsequent ease of aligning the slots and connecting the panels. The width of slot 34 is equal to a single sheet of corrugated board, which, in the preferred construction is triple wall and will be so described for the remainder of the sofa and also the chair design to be considered later. Extending inwardly from the slot 34 is a channel 36, and alongside the slot 34 is what I call a bottomed slot 38. The bottoms of channel 36 and bottomed slot 38 are coplanar. The width of the bottomed slot 38 is equal to a sheet of triple wall board, thereby making the width of channel 36 twice that of a triple wall board, or equal in thickness to the seat panel 16 with which it will ultimately join. Slot 34 has an inner end 40 which is intended to abut a corresponding inner end of a slot in the seat when the parts are later assembled.

An inclined but essentially vertical through-slot 42 for receiving the back panel 18 extends downwardly from the top edge 28 of panel 12. Its width and the width of a channel 44 are the same as a single sheet thickness of triple wall board. A bottomed slot 46 alongside and parallel to slot 42 is coplanar with the bottom of channel 44.

Referring now to FIGS. 5 and 6, and in particular to the right ends of each, a combined and aligned slot and channel 48 in back panel 18 and a combined and aligned slot and channel 50 in seat panel 16 cooperate with slot 42 and channel 44 and with slot 34 and channel 36 respectively. When back panel 18 is placed above side panel 12 with its plane in perpendicular relation to the side panel, back panel 18 is urged downwardly to cause a slot 52 to coincide with slot 42 and eventually a bottom edge of panel 18 will coincide with bottom 32 of side panel 12. At that time the combined slot and channel 48, together with the slot 42, channel 44 and bottomed slot 46 will constitute a unique interlocking joint of my invention. Having seen how these slots and channels cooperate, it will be clear that the combined slot and channel 50 in seat panel 16 forms a similar interlocking joint with the slot 34, channel 36 and bottomed slot 38 of panel 12.

What has been described thus far are three panels which constitute side, seat and back panels of a child's seat. All three intersect and are interlocked to provide a tight joint which is as strong as the materials are capable of providing. Subject to whether the panels are or are not to be painted, the slot and channel widths can be controlled to provide for joints with some dimensional tolerances which allow easy assembly and disassembly or can be made to be sufficiently tight after assembly in cases where knockdown is not often done. Since corrugated board is subject to moisture absorption and therefore capable of expansion, I prefer to protect the surfaces and joints with a surface finish such as paint.

Combined slots and channels 56 and 58 are provided in panels 18 and 16 at their right sides (actually their left ends as viewed in FIGS. 5 and 6). They correspond in function similarly to their respective combined slots and channels 48 and 50 at the left sides of the sofa. They cooperate with slots, channels and bottomed slots on the outside of right side panel 14. They compare identically to those in FIG. 3, but are a mirror image thereof. Because they are the same except for being mirror images, it is felt sufficient to describe but one end of the sofa elements and their connecting joints for a complete understanding of the construction.

Because of the length of the sofa 10, it is necessary to provide support of the seat panel 16 at least from below and preferably also at the rear. This is accomplished through the provision of the central supporting panel 20 shown in FIG. 1. Panel 20 is made of one central sheet 59 slotted at 60 and 62 for receipt of the seat panel 16 and back panel 18 respectively. A pair of gussets 61 and 63 are cemented to each side of central sheet 59, thereby providing a three sheet thickness of board directly below the center of seat panel 16. Cantilevered portions 64 and 66 along the upper and forward sides of slots 60 and 62 fit in width and height with channels 68 and 70 in seat panel 16 and back panel 18 respectively so as to be flush with the surfaces of the seat and back. A rib 72 may be added between the portions 64 and 66 for adding strength to the area between cantilevered portions 64 and 66.

In order to lock all panels together when the sofa is assembled and the inner ends of the several slots abut, a mortise and tenon type of joint is used, and, with only a single key 22 in the case of a chair or a pair of keys 22 in the case of a sofa, all of the panels can be secured to each other into a rigid, solid unit. In FIG. 5, the mortises are shown at 74 and 76. The tenons are represented by tongues 78 and 80 in FIG. 6. Slots 82 and 84 are provided in tongues 78 and 80 to receive the keys 22 which will be described in more detail in connection with FIG. 11.

Assembly of the sofa 10 is accomplished by first inserting the back panel 18 into the side panels and central supporting panel, and by then inserting the seat panel into the side panels and central supporting panel to a depth at which tongues 78 and 80 pass completely through mortises 74 and 76. The seat panel 16 bottoms when its rear edge 86 contacts surface 88 of back panel 18. The keys 22 are then inserted into slots 82 and 84 and the sofa is now a unitary child's seat. It can be easily picked up and moved about because of its light weight. A handle 90 is formed in the rear sheet of the back panel 18 as shown in FIG. 5 to enable such transportation while the unit is assembled.

A child's chair, i.e., a seat for a single individual, consists of the same pair of side panels 12 and 14 used for the sofa along with a back panel and a seat panel illustrated in FIGS. 9 and 10 respectively. Since the backs and seats of the chair and sofa are identical except for the absence of the central supporting panel in the chair and the need for only a single mortise and tenon type of connection, it is felt that the details of construction of the sofa will also suffice for the chair without added description. However, since the key 22 connection was not detailed for the sofa, it will be seen from FIG. 11 that the key has an upper head portion wider than its slot to seat it above the tongue. This is a common type of construction in children's furniture. The panels, slots and channels have been left unnumbered in FIGS. 9 and 10 since they are the same in dimensions and functions as their counterparts in FIGS. 5 and 6, particularly where the same side panels 12 and 14 can be used.

While the back and seat panels are essentially made of two sheets that are different in shape and registered along selected edges before cementing them together, the side panels are made of one full sheet and segments or parts of another so that after cementing, the segments or parts serve as though they were formed from a single sheet. For example, as seen in FIG. 3, all of sheet parts 94, 96 and 98 lie in the same plane, cemented to the sheet that constitutes the bottoms of channels 36 and 44. In addition, the back panel 18 and its counterpart in the chair configuration of FIG. 9 are provided with what can best be described as cleats 100 which strengthen the back panels at their bottom corners. The top corners of the side panels and the back panel and the front corners of the seat panel may be angled or rounded to provide a more attractive appearance as well as to minimize risk of injury to a user in case of a fall into or bump against the furniture.

Reinforcing rods or stiffeners 102 are shown in FIGS. 9 and 10 for strengthening selected areas which may either be subject to greatest stress or are potential areas of damage due to reduced area of surrounding sheet material. The examples illustrated are narrow extensions at the outer ends or sides of the seat and back panels. The rods may be small diameter fiberglass or wooden dowel rods or may be flat stiffeners of any material which is strong against breaking when being bent. Any type of tool may be used to create an indentation of the rod in at least one of the sheets before cementing them together so as to enable contact of the adhering surfaces. A rod may protrude across a channel as shown in full lines in FIG. 9, provided it does not interfere with assembly of the panels. The rod may in some instances provide for a tighter construction of the joint where a panel edge fits within a channel. Such stiffeners have greater usefulness where the sheets may not be triple wall board.

The improved joint of my invention is best described in connection with FIGS. 2 and 4. FIG. 2 is a fragmentary perspective view similar to the elevational view of FIG. 3 and shows the vertically-directed flutes of the corrugated board. The seat panel 16 and the back panel 18 are shown in dotted lines in FIG. 2 to illustrate the manner in which they intersect with the side panel 12. This figure also helps one better appreciate the construction of the interlocking joints. FIG. 4, while taken along either set of lines 4—4 of FIG. 3, further assists in an understanding of the resistance of the joint to horizontal and vertical forces applied to the panels 12 and 16 as illustrated by the eight arrows in that figure.

While the selection of the direction of the flutes may vary depending on the type and size of the piece of furniture, and may even be oppositely directed for a pair of sheets of a given panel, the flutes of the panels described are as shown by the arrows "f" on each of the panels. These and other aspects of my invention may be varied without departing from the spirit and scope of the claims.

Having described my invention, I claim:

1. A unit of child's furniture having a pair of mirror-image, parallel, generally rectangular planar side panels each having front, top, back and bottom edges, each of said side panels having a first slot extending generally horizontally inwardly from its front edge toward its back edge and a second slot extending generally vertically downwardly from its top edge toward its bottom edge; a generally horizontal seat panel extending perpendicularly between and intersecting both of said side panels, said seat panel having a front edge and a rear edge and a pair of parallel third slots extending perpendicularly from the rear edge forwardly toward the front edge of said seat panel; a generally vertical back panel extending perpendicularly between and intersecting both of said side panels, said back panel having a top edge and a bottom edge and a pair of fourth parallel slots extending perpendicularly upwardly from the bottom edge toward the top edge of said back panel; all of said slots, when the side, seat and back panels are assembled to form said unit of child's furniture, having inner ends of each of said first and third slots abutting each other and inner ends of said second and fourth slots abutting each other; the improvement comprising:

means restraining portions of said side panels adjacent their front edges against lateral horizontally outward movement from said seat panel, said restraining means comprising a parallel-sided channel generally aligned with said first slots on each of said side panels and interfitting with said third slots of said seat panel and a parallel-sided channel extending from and being aligned with each of said third slots toward the front edge of the seat panel, and a bottomed slot portion laterally adjacent said first slot on each of said side panels and being receivable in the channel portions of said seat panel, to provide, together with said first and third slots, a pair of first interlocking joints extending along the intersection of the seat panel with each side panel, said first interlocking joint resisting forces directed perpendicularly to the planes of said side panels.

2. The invention according to claim 1 including means restraining second portions of said side panels adjacent their top edges against laterally horizontal movement outwardly from said back panel, said second restraining means comprising a second parallel-sided channel aligned generally linearly with said second slots on each of said side panels and interfitting with said fourth slots of said back panel, a parallel-sided channel aligned with and extending linearly from each of said fourth slots toward the top edge of said back panel, and a second bottomed slot portion laterally adjacent said second slots on each of said side panels and being receivable in the channel portions of said back panel, to provide, together with said second and fourth slots, a pair of second interlocking joints extending along the intersections of the back panel with each side panel, said second interlocking joints resisting forces directed perpendicularly to the planes of said side panels.

3. The invention according to claim 2 wherein each of said side, seat and back panels consists of a pair of flat multiple-wall corrugated sheets having at least portions of adjacent sides cemented together to form each panel of a thickness equal to the combined thicknesses of both sheets of each pair.

4. The invention according to claim 3 wherein the depth of each of said channels is equal to the thickness of one of said sheets of each pair, of carrugated sheets and wherein each channel is initially created as a slot in said one sheet prior to cementing said one sheet to the other sheet with which it forms the channel.

5. The invention according to claim 3 wherein each of said multiple-wall sheets is of a triple-wall thickness.

* * * * *